US010928110B2

(12) United States Patent
Broadbent et al.

(10) Patent No.: US 10,928,110 B2
(45) Date of Patent: Feb. 23, 2021

(54) ICE MAKER WITH REVERSING CONDENSER FAN MOTOR TO MAINTAIN CLEAN CONDENSER

(71) Applicant: True Manufacturing Co., Inc., O'Fallon, MO (US)

(72) Inventors: John Allen Broadbent, Denver, CO (US); John Friend, Washington, MO (US)

(73) Assignee: True Manufacturing Co., Inc., O'Fallon, MO (US)

( * ) Notice: Subject to any disclaimer, the term of this patent is extended or adjusted under 35 U.S.C. 154(b) by 824 days.

(21) Appl. No.: 15/145,262

(22) Filed: May 3, 2016

(65) Prior Publication Data

US 2016/0327352 A1 Nov. 10, 2016

Related U.S. Application Data

(60) Provisional application No. 62/157,582, filed on May 6, 2015.

(51) Int. Cl.
*F28G 3/16* (2006.01)
*F28G 15/00* (2006.01)
(Continued)

(52) U.S. Cl.
CPC ..... *F25B 39/00* (2013.01); *F25B 47/00* (2013.01); *F25C 1/04* (2013.01); *F25C 5/10* (2013.01);
(Continued)

(58) Field of Classification Search
CPC ..... F25D 2323/00283; F25D 21/008; F25D 2400/22; F25B 47/00; F25B 2600/11;
(Continued)

(56) References Cited

U.S. PATENT DOCUMENTS 2,525,462 A * 10/1950 Shell ..... F25B 49/025 62/178
4,522,036 A 6/1985 Van Gils
(Continued)

FOREIGN PATENT DOCUMENTS

CN 102278803 A 12/2011
JP 1975-145541 A 12/1975
(Continued)

OTHER PUBLICATIONS

Patent Cooperation Treaty, International Search Report for PCT/US2016/030525, dated Aug. 11, 2016, 3 pages.
(Continued)

*Primary Examiner* — Nelson J Nieves
*Assistant Examiner* — Meraj A Shaikh
(74) *Attorney, Agent, or Firm* — Stinson LLP

(57) ABSTRACT

An ice maker for forming ice having a refrigeration system, a water system, and a control system. The refrigeration system includes a compressor, a condenser, an ice formation device, and a condenser fan comprising a fan blade and a condenser fan motor for driving the fan blade. The water system supplies water to the ice formation device. The control system includes a controller adapted to operate the condenser fan motor at a first speed in a forward direction when the ice maker is making ice and adapted to operate the condenser fan motor at a second speed in a reverse direction when the ice maker is not making ice. Operating the condenser fan motor at the second speed in the reverse direction is sufficient to reduce the amount of dirt, lint, grease, dust, and/or other contaminants on or in the condenser.

12 Claims, 11 Drawing Sheets

(51) Int. Cl.

| | |
|---|---|
| ***F25B 39/00*** | (2006.01) |
| ***F25C 1/04*** | (2018.01) |
| ***F25C 5/10*** | (2006.01) |
| ***F25C 5/182*** | (2018.01) |
| ***F25B 47/00*** | (2006.01) |
| *F25B 39/04* | (2006.01) |

(52) U.S. Cl.
CPC ..... *F25C 5/182* (2013.01); *F25B 39/04* (2013.01); *F25B 2600/0251* (2013.01); *F25B 2600/111* (2013.01); *F25B 2600/2513* (2013.01); *F25B 2700/21175* (2013.01); *F25C 2600/04* (2013.01); *F25C 2700/02* (2013.01); *F25C 2700/04* (2013.01); *F25D 2323/00283* (2013.01); *F25D 2400/22* (2013.01)

(58) Field of Classification Search
CPC .. F25B 2600/111; F25B 39/04; F25B 49/027; Y02B 30/743
See application file for complete search history.

(56) References Cited

U.S. PATENT DOCUMENTS

| | | | | |
|---|---|---|---|---|
| 5,239,836 | A * | 8/1993 | Sakai | F25C 1/12 261/DIG. 46 |
| 5,458,851 | A | 10/1995 | Schroeder et al. | |
| 5,460,007 | A | 10/1995 | Reed et al. | |
| 5,617,728 | A | 4/1997 | Kim et al. | |
| 6,109,043 | A | 8/2000 | Lu et al. | |
| 6,619,051 | B1 | 9/2003 | Kilawee et al. | |
| 2002/0124586 | A1 | 9/2002 | Trulaske, Sr. | |
| 2003/0010055 | A1* | 1/2003 | Kuroyanagi | F25C 1/147 62/354 |
| 2005/0034844 | A1* | 2/2005 | Trulaske, Sr. | F25B 47/00 165/95 |
| 2005/0076654 | A1* | 4/2005 | Chung | F25D 11/02 62/66 |
| 2005/0109056 | A1* | 5/2005 | Rand | F25B 5/04 62/340 |
| 2006/0080982 | A1* | 4/2006 | Reichle | F25B 39/04 62/181 |
| 2006/0277928 | A1* | 12/2006 | McDougal | F25C 5/187 62/66 |
| 2008/0236180 | A1 | 10/2008 | Tran | |
| 2010/0139306 | A1* | 6/2010 | Krenik | F25B 9/004 62/402 |
| 2014/0208792 | A1 | 7/2014 | Broadbent | |

FOREIGN PATENT DOCUMENTS

| | | | |
|---|---|---|---|
| JP | S54-129845 | U | 9/1979 |
| JP | 02223771 | A | 9/1990 |
| JP | 05-180590 | A | 7/1993 |
| JP | 09303914 | A | 11/1997 |
| JP | 10-54602 | A | 2/1998 |
| JP | 2000123238 | A | 4/2000 |
| JP | 2007-155270 | A | 6/2007 |
| JP | 2008-190851 | | 8/2008 |
| JP | 2010-522865 | A | 7/2010 |
| JP | 2013-124789 | A | 6/2013 |
| KR | 10-2006-0068755 | A | 6/2006 |
| RU | 41577 | | 11/2004 |
| WO | 2010077700 | | 7/2010 |
| WO | 2012106484 | A2 | 8/2012 |

OTHER PUBLICATIONS

Patent Cooperation Treaty, International Search Report for PCT/US2014/0013250, dated Aug. 28, 2014, 3 pages.

Supplementary European Search Report, Application No. 16789924.4-1099, dated Dec. 14, 2018, pp. 7.

* cited by examiner

ICE MAKER WITH REVERSING CONDENSER FAN MOTOR TO MAINTAIN CLEAN CONDENSER

FIELD OF THE INVENTION

This invention relates generally to automatic ice making machines and, more particularly, to ice making machines with a reversing condenser fan motor to maintain a clean condenser.

BACKGROUND OF THE INVENTION

Ice making machines, or ice makers, typically comprise a refrigeration and water system that employs a source of refrigerant flowing serially through a compressor, a condenser, a refrigerant expansion device, an evaporator, and a freeze plate comprising a lattice-type cube mold thermally coupled with the evaporator. Additionally, typical ice makers employ gravity water flow and ice harvest systems that are well known and in extensive use. Ice makers having such a refrigeration and water system are often disposed on top of ice storage bins, where ice that has been harvested is stored until it is needed. Such ice makers may also be of the "self-contained" type wherein the ice maker and ice storage bin are a single unit. Such ice makers have received wide acceptance and are particularly desirable for commercial installations such as restaurants, bars, motels and various beverage retailers having a high and continuous demand for fresh ice.

After prolonged operation of the ice maker, dirt, lint, grease, dust, and/or other contaminants accumulate on or in the condenser, thereby reducing the efficiency of the condenser and the ice maker as a whole. Ice makers transfer significant amounts of heat, much more so than a typical refrigerator or freezer, and therefore need higher capacity condensers. As such, the cleanliness of the condenser is important to the continued proper operation of the ice maker. Therefore it is necessary to periodically clean the condenser.

SUMMARY OF THE INVENTION

One aspect of the invention is directed to an ice maker for forming ice, the ice maker comprising a refrigeration system, a water system, and a control system. The refrigeration system comprises a compressor, a condenser, an ice formation device, and a condenser fan comprising a fan blade and a condenser fan motor for driving the fan blade. The compressor, condenser and ice formation device are in fluid communication by one or more refrigerant lines. The water system is adapted to supply water to the ice formation device. The control system comprises a controller adapted to operate the condenser fan motor at a first speed in a forward direction when the ice maker is making ice and adapted to operate the condenser fan motor at a second speed in a reverse direction when the ice maker is not making ice. Operating the condenser fan motor at the second speed in the reverse direction is sufficient to reduce the amount of dirt, lint, dust, and/or other contaminants on or in the condenser.

Another aspect of the invention is directed to an ice maker for forming ice, the ice maker comprising a refrigeration system, a water system, an ice level sensor, and a control system. The refrigeration system comprises a compressor, a condenser, an ice formation device, and a condenser fan comprising a fan blade and a condenser fan motor for driving the fan blade. The compressor, condenser and ice formation device are in fluid communication by one or more refrigerant lines. The water system is adapted to supply water to the ice formation device. The ice maker is adapted to harvest ice into an ice storage bin and the ice level sensor is adapted to monitor the level of ice in the ice storage bin. The control system comprises a controller adapted to operate the condenser fan motor at a first speed in a forward direction when the ice maker is making ice and adapted to operate the condenser fan motor at a second speed in a reverse direction when the controller receives an indication from the ice level sensor that the ice storage bin is full of ice. Operating the condenser fan motor at the second speed in the reverse direction is sufficient to reduce the amount of dirt, lint, dust, and/or other contaminants on or in the condenser.

Another aspect of the invention is directed to a method of controlling an ice maker. The ice maker comprises a refrigeration system, a water system, and a control system. The refrigeration system comprises a compressor, a condenser, an ice formation device, and a condenser fan comprising a fan blade and a condenser fan motor for driving the fan blade. The compressor, condenser and ice formation device are in fluid communication by one or more refrigerant lines. The water system is adapted to supply water to the ice formation device. The control system comprises a controller adapted to operate the condenser fan motor. The method comprises operating the condenser fan motor at a first speed in a forward direction when the ice maker is making ice, and operating the condenser fan motor at a second speed in a reverse direction when the ice maker is not making ice. Operating the condenser fan motor at the second speed in the reverse direction is sufficient to reduce the amount of dirt, lint, dust, and/or other contaminants on or in the condenser.

Yet another aspect of the invention is directed to a method for controlling an ice maker. The ice maker comprising a refrigeration system, a water system, an ice level sensor, and a control system. The refrigeration system comprises a compressor, a condenser, an ice formation device, and a condenser fan comprising a fan blade and a condenser fan motor for driving the fan blade. The compressor, condenser and ice formation device are in fluid communication by one or more refrigerant lines. The water system is adapted to supply water to the ice formation device. The ice maker is adapted to harvest ice into an ice storage bin and the ice level sensor is adapted to monitor the level of ice in the ice storage bin. The control system comprises a controller adapted to operate the condenser fan motor. The method comprises operating the condenser fan motor in at a first speed in a forward direction when the ice maker is making ice, and determining whether the ice storage bin is full of ice using the ice level sensor. When the ice storage bin is full of ice, the controller turns the compressor off and turns the condenser fan motor on at a second speed in the reverse direction for a period of time to reduce the amount of dirt, lint, dust, and/or other contaminants on or in the condenser.

BRIEF DESCRIPTION OF THE FIGURES

These and other features, aspects and advantages of the invention will become more fully apparent from the following detailed description, appended claims, and accompanying drawings, wherein the drawings illustrate features in accordance with exemplary embodiments of the invention, and wherein:

Like reference numerals indicate corresponding parts throughout the several views of the various drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. All numbers expressing measurements and so forth used in the specification and claims are to be understood as being modified in all instances by the term "about." It should also be noted that any references herein to front and back, right and left, top and bottom and upper and lower are intended for convenience of description, not to limit an invention disclosed herein or its components to any one positional or spatial orientation.

Figure 1:
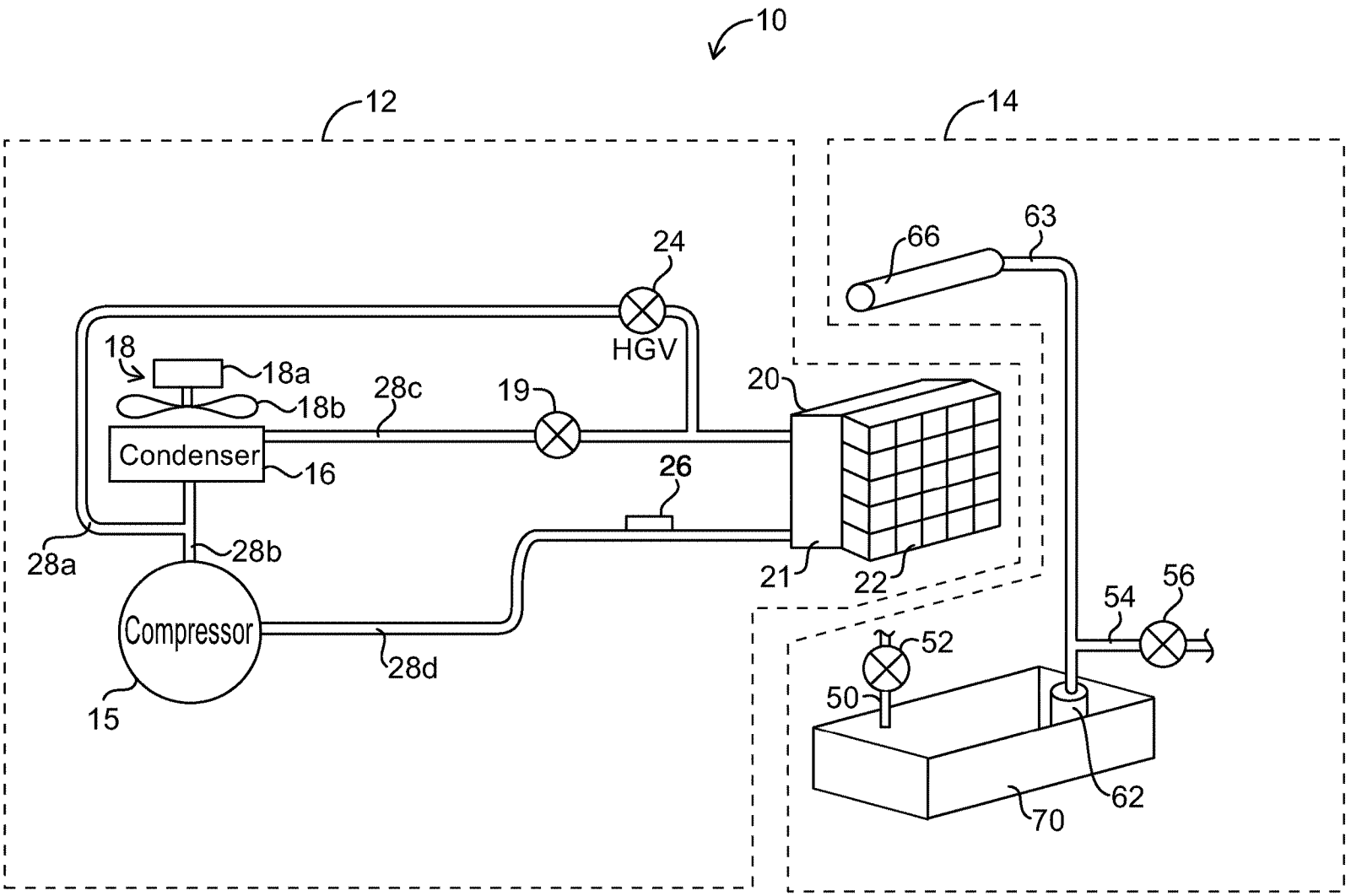
FIG. 1 is a schematic drawing of an ice maker having various components according to an embodiment of the invention.

FIG. 1 illustrates certain principal components of one embodiment of a grid-type ice maker 10 having a refrigeration system 12 and water system 14. The refrigeration system 12 of ice maker 10 includes compressor 15, condenser 16 for condensing compressed refrigerant vapor discharged from the compressor 15, refrigerant expansion device 19 for lowering the temperature and pressure of the refrigerant, ice formation device 20, and hot gas valve 24. Refrigerant expansion device 19 may include, but is not limited to, a capillary tube, a thermostatic expansion valve or an electronic expansion valve. Ice formation device 20 includes evaporator 21 and freeze plate 22 thermally coupled to evaporator 21. Evaporator 21 is constructed of serpentine tubing (not shown) as is known in the art. Freeze plate 22 contains a large number of pockets (usually in the form of a grid of cells) on its surface where water flowing over the surface can collect. Hot gas valve 24 is used to direct warm refrigerant from compressor 15 directly to evaporator 21 to remove or harvest ice cubes from freeze plate 22 when the ice has reached the desired thickness.

Ice maker 10 also includes a temperature sensor 26 placed at the outlet of the evaporator 21 to control refrigerant expansion device 19. If refrigerant expansion device 19 is a thermal expansion valve (TXV), then sensor 26 and expansion device 19 are connected by a capillary tube (not shown) that allows expansion device 19 to be controlled by temperature sensor 26 via the pressure of the refrigerant contained therein. If refrigerant expansion device 19 is an electronic expansion valve, then temperature sensor 26 may be in electrical, signal, and/or data communication with controller 80 which in turn may be in electrical, signal, and/or data communication with refrigerant expansion device 19 to control refrigerant expansion device 19 in response to the temperature measured by temperature sensor 26 (see FIG. 2). In various embodiments, for example, temperature sensor 26 may be in electrical, signal, and/or data communication with refrigerant expansion device 19. In other embodiments, where refrigerant expansion device 19 is an electronic expansion valve, ice maker 10 may also include a pressure sensor (not shown) placed at the outlet of the evaporator 21 to control refrigerant expansion device 19 as is known in the art.

Figure 1A:
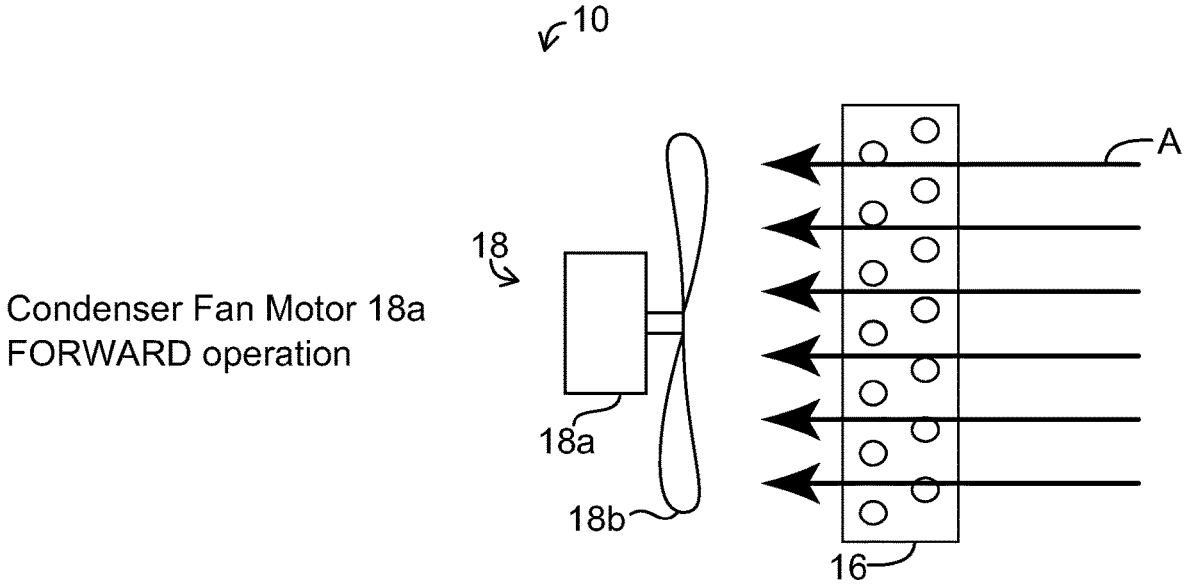
FIG. 1A is a schematic drawing of a condenser fan operating in a forward direction to draw air through a condenser of an ice maker according to an embodiment of the invention.
Figure 1B:
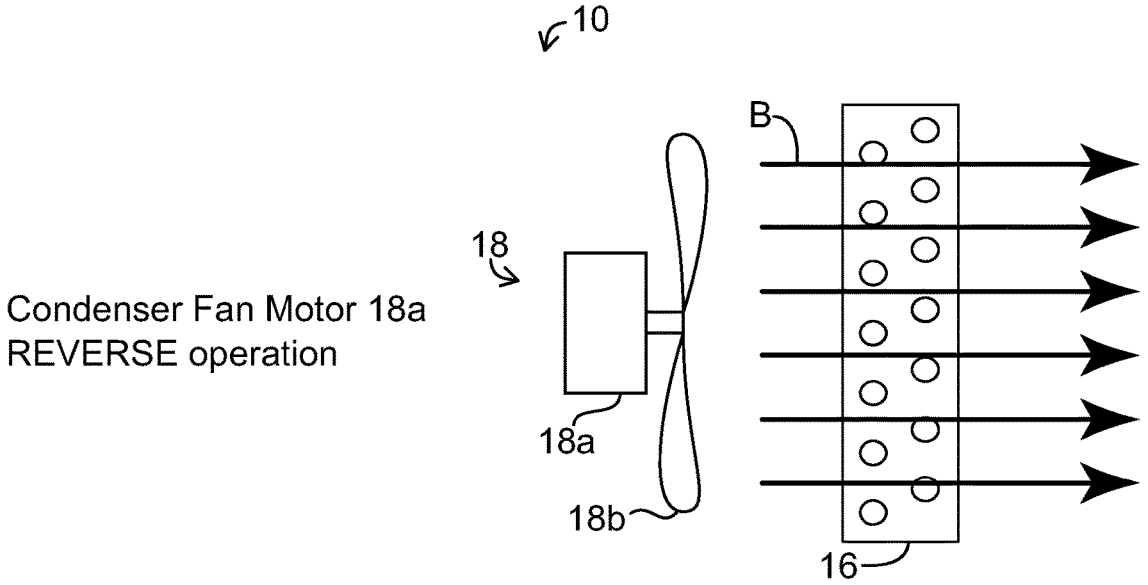
FIG. 1B is a schematic drawing of a condenser fan operating in a reverse direction to blow air through a condenser of an ice maker according to an embodiment of the invention.

Condenser 16 may be a conventional condenser having a population of refrigerant passes (e.g., serpentine tubing, micro-channels) and a population fins. A condenser fan 18 may be positioned to blow a gaseous cooling medium (e.g., air) across condenser 16 to provide cooling of condenser 16. Condenser fan 18 may include a condenser fan motor 18*a* and fan blade(s) 18*b*, wherein the fan blades 18*b* are rotated by fan motor 18*a*. Preferably, condenser fan motor 18*a* is adapted to operate in a forward direction to draw air through condenser 16 (see Arrows A in FIG. 1A) and is adapted to operate in a reverse direction to blow air through condenser 16 (see Arrows B in FIG. 1B). It will be understood that in other embodiments, that condenser fan motor 18*a* may be adapted to operate in a forward direction to blow air through condenser 16 and may be adapted to operate in a reverse direction to draw air through condenser 16, without departing from the scope of the invention. Preferably, condenser fan motor 18*a* of condenser fan 18 is an electrically commutated motor (ECM) and the forward and reverse operation is controlled by controller 80 (see FIG. 2).

As described more fully elsewhere herein, a form of refrigerant cycles through the components of refrigeration system 12 via refrigerant lines 28*a*, 28*b*, 28*c*, 28*d*.

The water system 14 of ice maker 10 includes water pump 62, water line 63, water distributor 66 (e.g., manifold, pan, tube, etc.), and sump 70 located below freeze plate 22 adapted to hold water. During operation of ice maker 10, as water is pumped from sump 70 by water pump 62 through water line 63 and out of water distributor 66, the water impinges on freeze plate 22, flows over the pockets of freeze plate 22 and freezes into ice. Sump 70 may be positioned below freeze plate 22 to catch the water coming off of freeze plate 22 such that the water may be recirculated by water pump 62. Water distributor 66 may be the water distributors described in copending U.S. Patent Application Publication No. 2014/0208792 to Broadbent, filed Jan. 29, 2014, the entirety of which is incorporated herein by reference.

Water system 14 of ice maker 10 further includes water supply line 50 and water inlet valve 52 in fluid communication therewith for filling sump 70 with water from a water source (not shown), wherein some or all of the supplied water may be frozen into ice. Water system 14 of ice maker 10 further includes water discharge line 54 and discharge valve 56 (e.g., purge valve, drain valve) disposed thereon. Water and/or any contaminants remaining in sump 70 after ice has been formed may be discharged via water discharge line 54 and discharge valve 56. In various embodiments, water discharge line 54 may be in fluid communication with water line 63. Accordingly, water in sump 70 may be discharged from sump 70 by opening discharge valve 56 when water pump 62 is running.

Figure 2:
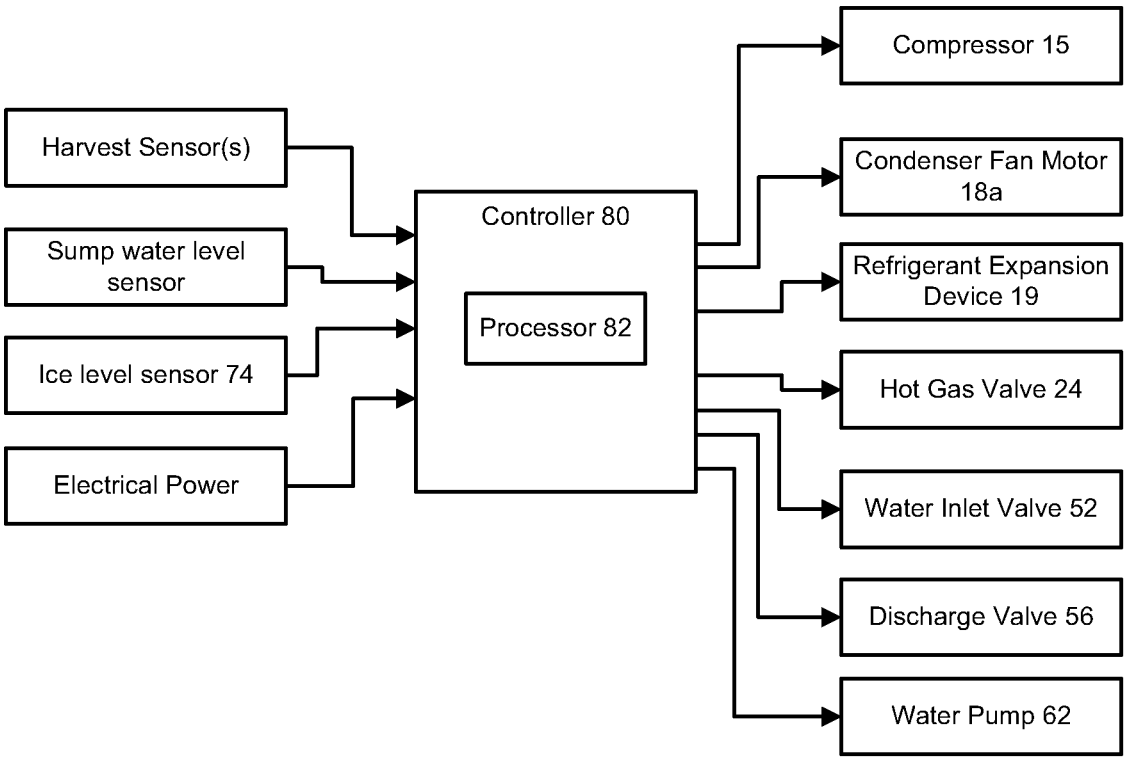
FIG. 2 is a schematic drawing of a controller for controlling the operation of the various components of an ice maker according to the an embodiment of the invention.

Referring now to FIG. 2, ice maker 10 also includes a controller 80. Controller 80 may be located remote from ice formation device 20 and sump 70. Controller 80 may include a processor 82 for controlling the operation of ice maker 10. Processor 82 of controller 80 may include a processor-readable medium storing code representing instructions to cause processor 82 to perform a process. Processor 82 may be, for example, a commercially available microprocessor, an application-specific integrated circuit (ASIC) or a combination of ASICs, which are designed to achieve one or more specific functions, or enable one or more specific devices or applications. In yet another embodiment, controller 80 may be an analog or digital circuit, or a combination of multiple circuits. Controller 80 may also include one or more memory components (not shown) for storing data in a form retrievable by controller 80. Controller 80 can store data in or retrieve data from the one or more memory components.

In various embodiments, controller 80 may also comprise input/output (I/O) components (not shown) to communicate with and/or control the various components of ice maker 10. In certain embodiments, for example controller 80 may receive inputs from a harvest sensor, temperature sensor(s) 26 (see FIG. 1), a sump water level sensor, ice level sensor 74 (see FIG. 3A), an electrical power source (not shown), and/or a variety of sensors and/or switches including, but not limited to, pressure transducers, acoustic sensors, etc. In various embodiments, based on those inputs for example, controller 80 may be able to control compressor 15, condenser fan motor 18*a*, refrigerant expansion device 19, hot gas valve 24, water inlet valve 52, discharge valve 56, and/or water pump 62. Specifically, as described in greater detail elsewhere herein, when controller 80 receives an indication from ice level sensor 74 that ice storage bin 31 (see FIG. 3A) is full, controller 80 may operate condenser fan motor 18*a* in reverse so that condenser fan 18 can blow dirt, lint, dust, and/or other contaminants from condenser 16. Preferably, running of condenser fan 18*a* in reverse is done while the remaining components of the refrigeration system are off.

Figure 3:
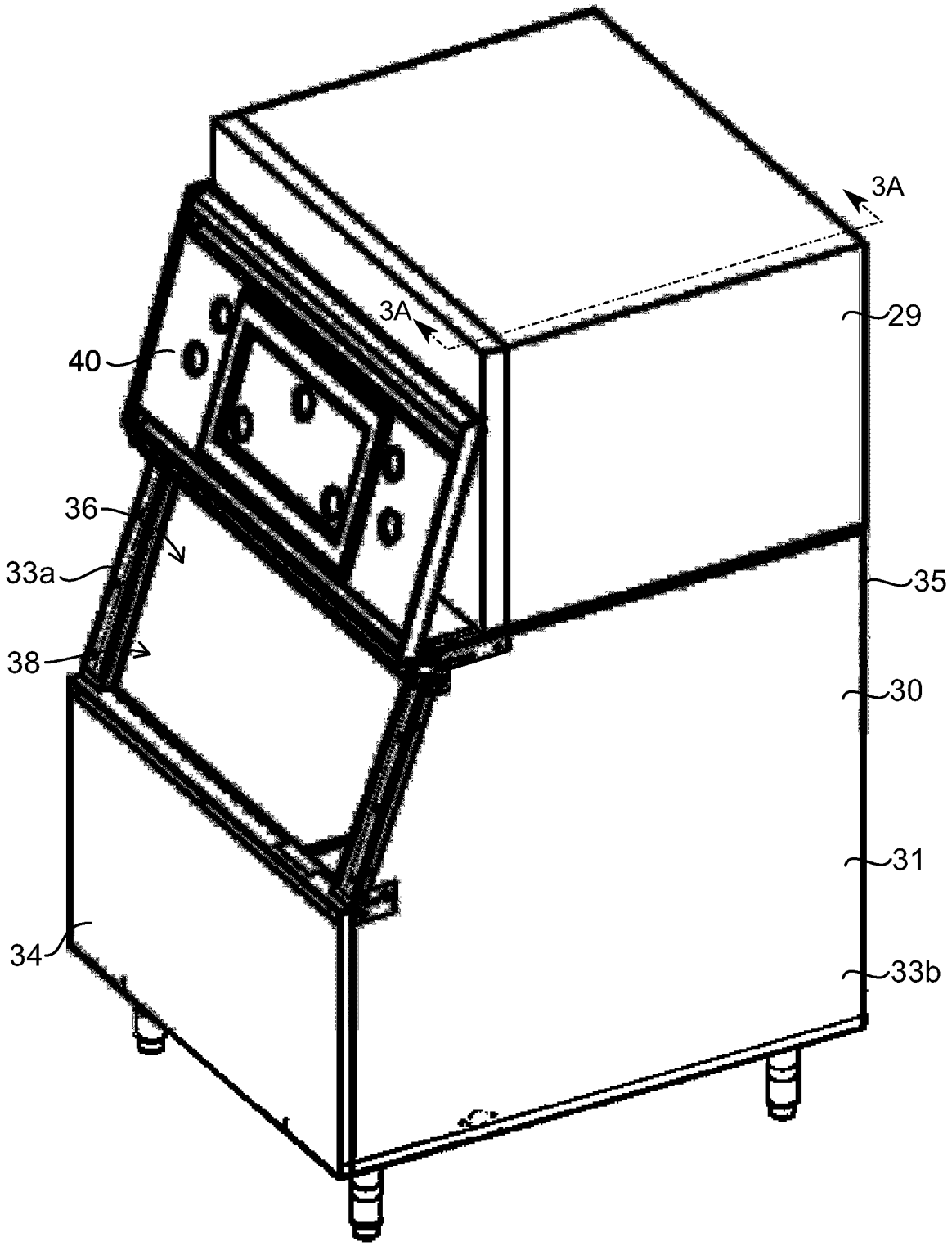
FIG. 3 is a right perspective view of an ice maker disposed within a cabinet wherein the cabinet is disposed on an ice storage bin assembly according to the an embodiment of the invention.
Figure 3A:
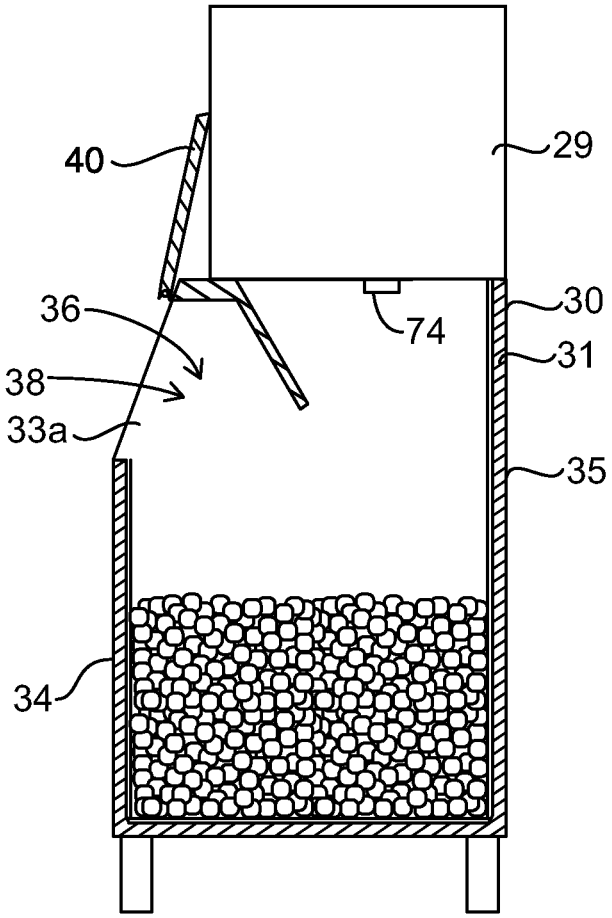
FIG. 3A is a right section view of an ice maker disposed within a cabinet wherein the cabinet is disposed on an ice storage bin assembly according to the an embodiment of the invention.

In many embodiments, as illustrated in FIG. 3, ice maker 10 may be disposed inside of a cabinet 29 which may be mounted on top of an ice storage bin assembly 30. Cabinet 29 may be closed by suitable fixed and removable panels to provide temperature integrity and compartmental access, as will be understood by those in the art. Ice storage bin assembly 30 includes an ice storage bin 31 having an ice hole (not shown) through which ice produced by ice maker 10 falls. The ice is then stored in cavity 36 until retrieved. Ice storage bin 31 further includes an opening 38 which provides access to the cavity 36 and the ice stored therein. Cavity 36, ice hole (not shown) and opening 38 are formed by a left wall 33*a*, a right wall 33*b*, a front wall 34, a back wall 35 and a bottom wall (not shown). The walls of ice storage bin 31 may be thermally insulated with various insulating materials including, but not limited to, fiberglass insulation or open- or closed-cell foam comprised, for example, of polystyrene or polyurethane, etc. in order to retard the melting of the ice stored in ice storage bin 31. A door 40 can be opened to provide access to cavity 36. In other embodiments, ice maker 10 may be disposed inside a cabinet 29 which may be mounted on top of an ice dispenser (not shown) as known in the art. For example, ice maker 10 may be mounted on an ice dispenser in a restaurant, cafeteria, hospital, hotel, or other locations where users can dispense ice into cups, buckets, or other receptacles in a self-service fashion.

In addition to the components described above, ice maker 10 may have other conventional components not described herein without departing from the scope of the invention.

Having described each of the individual components of one embodiment of ice maker 10, the manner in which the components interact and operate in various embodiments may now be described in reference again to FIG. 1. During operation of ice maker 10 in an ice making cycle, compressor 15 receives low-pressure, substantially gaseous refrigerant from evaporator 21 through suction line 28*d*, pressurizes the refrigerant, and discharges high-pressure, substantially gaseous refrigerant through discharge line 28*b* to condenser 16. In condenser 16, heat is removed from the refrigerant, causing the substantially gaseous refrigerant to condense into a substantially liquid refrigerant. The heat is removed from condenser 16 by controller 80 operating condenser fan motor 18*a* in a forward direction to draw ambient air from outside ice maker 10 across condenser 16. Condenser fan 18 preferably operates continuously in the forward direction during the ice making cycle. The substantially liquid refrigerant exiting condenser 16 may include some gas such that the refrigerant is a liquid-gas mixture.

After exiting condenser 16, the high-pressure, substantially liquid refrigerant is routed through liquid line 28*c* to refrigerant expansion device 19, which reduces the pressure of the substantially liquid refrigerant for introduction into evaporator 21 at inlet 21*a*. As the low-pressure expanded refrigerant is passed through tubing of evaporator 21, the refrigerant absorbs heat from the tubes contained within evaporator 21 and vaporizes as the refrigerant passes through the tubes. Low-pressure, substantially gaseous refrigerant is discharged from outlet 21*b* of evaporator 21 through suction line 28*d*, and is reintroduced into the inlet of compressor 15.

In certain embodiments of the invention, at the start of the ice making cycle, a water fill valve 52 is turned on to supply a mass of water to sump 70 and water pump 62 is turned on. The ice maker will freeze some or all of the mass of water into ice. After the desired mass of water is supplied to sump 70, the water fill valve may be closed. Compressor 15 is turned on to begin the flow of refrigerant through refrigeration system 12. Water pump 62 circulates the water over freeze plate 22 via water line 63 and water distributor 66. The water that is supplied by water pump 62 then begins to cool as it contacts freeze plate 22, returns to water sump 70 below freeze plate 22 and is recirculated by water pump 62 to freeze plate 22. Once the water is sufficiently cold, water flowing across freeze plate 22 starts forming ice cubes.

After the ice cubes are formed such that the desired ice cube thickness is reached, water pump 62 is turned off and the harvest portion of the ice making cycle is initiated by opening hot gas valve 24. This allows warm, high-pressure gas from compressor 15 to flow through hot gas bypass line 28*a* to enter evaporator 21 at inlet 21*a*. The warm refrigerant flows through the serpentine tubing of evaporator 21 and a heat transfer occurs between the warm refrigerant and the evaporator 21. This heat transfer warms evaporator 21, freeze plate 22, and the ice formed in freeze plate 22. This results in melting of the formed ice to a degree such that the ice may be released from freeze plate 22 and falls into ice storage bin 31 where the ice can be temporarily stored and later retrieved.

Figure 4:
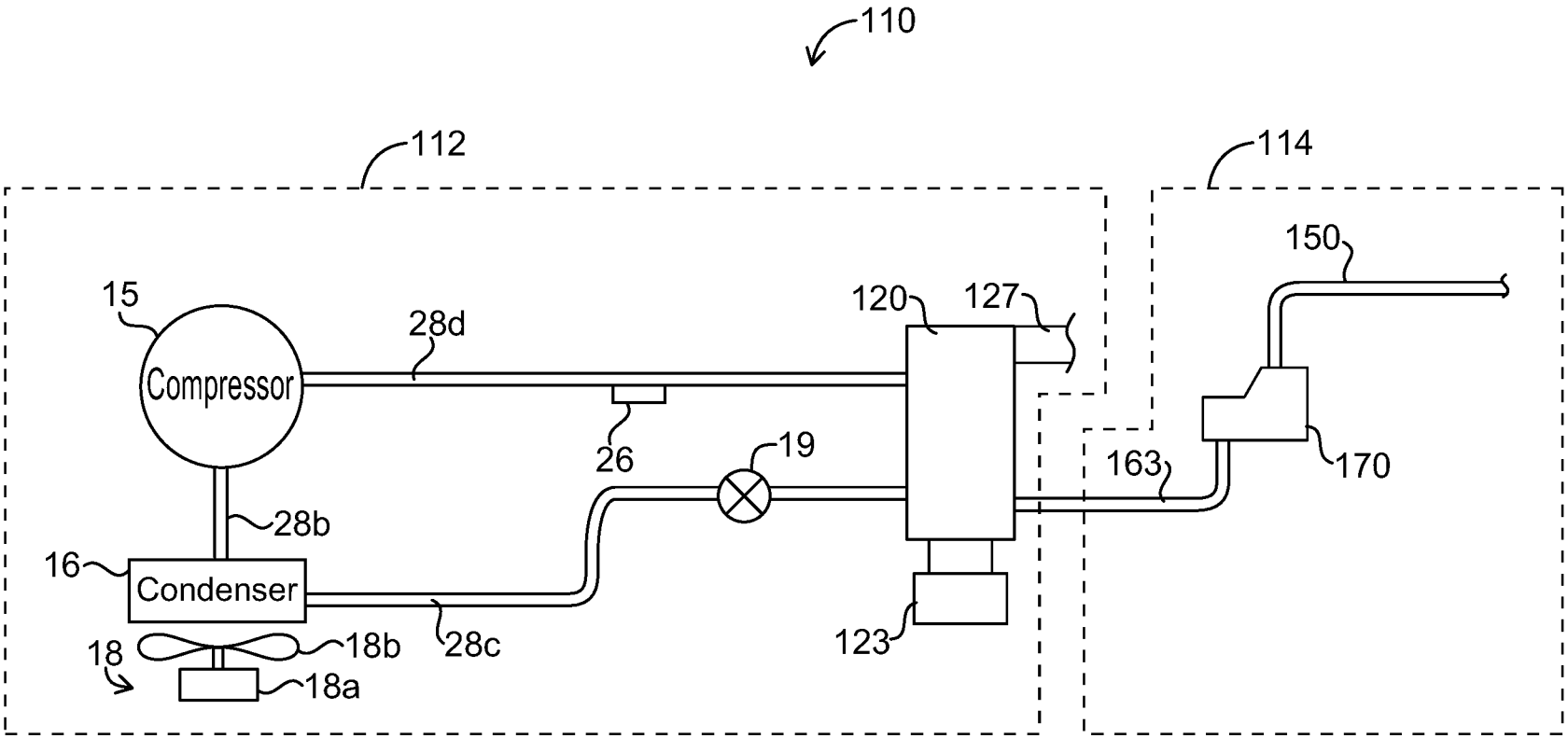
FIG. 4 is a schematic drawing of an ice maker having various components according to an embodiment of the invention.
Figure 5:
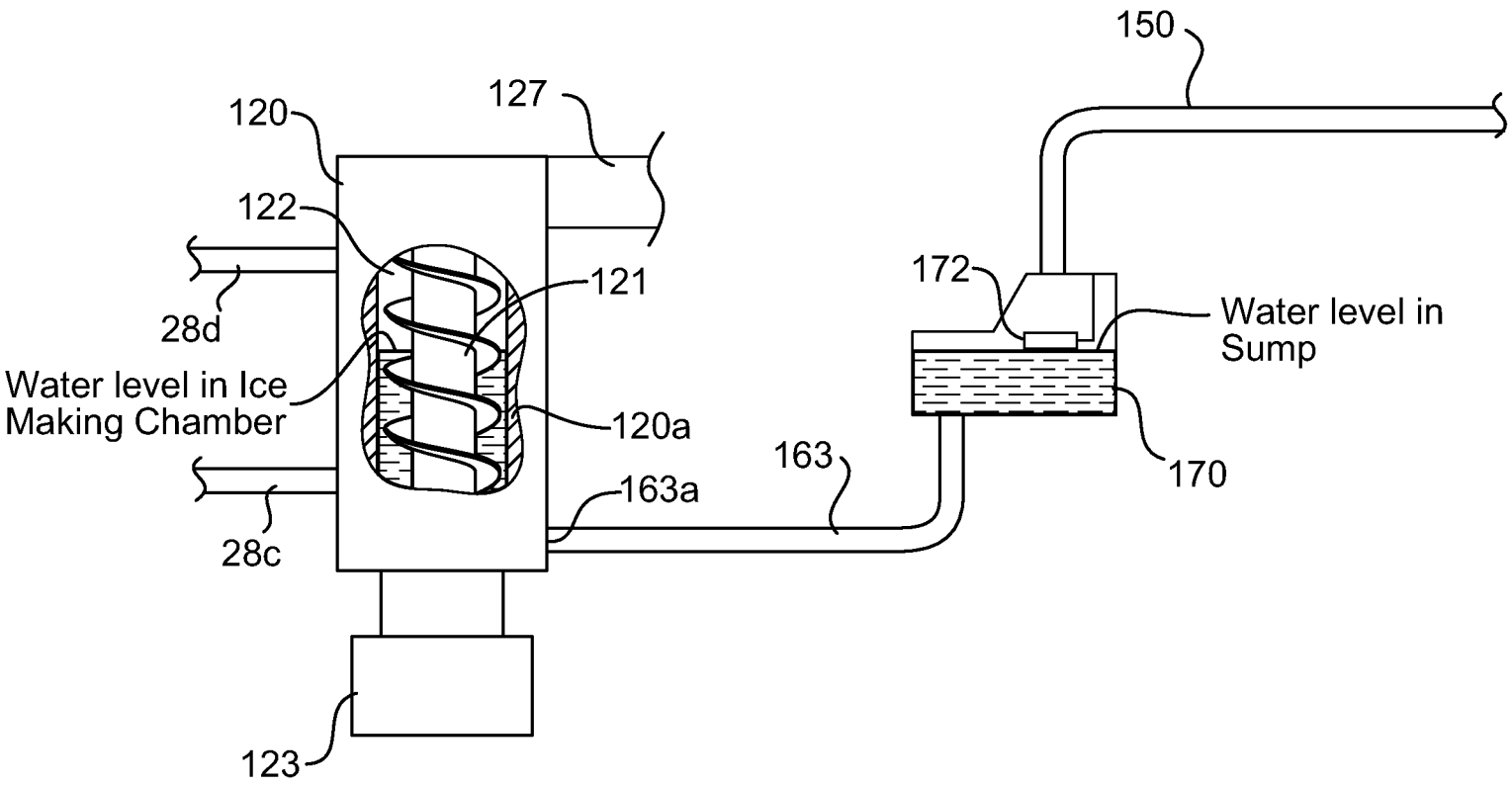
FIG. 5 is a schematic drawing of an ice maker having various components according to an embodiment of the invention.

An alternative embodiment of an ice maker of the disclosure for making flake or nugget-type ice is illustrated in FIGS. 4 and 5 and is described below. Some features of one or more of ice makers 10 and 110 are common to one another and, accordingly, descriptions of such features in one embodiment should be understood to apply to other embodiments. Furthermore, particular characteristics and aspects of one embodiment may be used in combination with, or instead of, particular characteristics and aspects of another embodiment.

FIGS. 4 and 5 illustrate certain principal components of another embodiment of ice maker 110 having a refrigeration system 112 and water system 114. Ice maker 110 produces flake or nugget-type ice. The refrigeration system 112 of ice maker 110 includes compressor 15, condenser 16 for condensing compressed refrigerant vapor discharged from the compressor 15, refrigerant expansion device 19 for lowering the temperature and pressure of the refrigerant, and ice formation device 120. As described more fully elsewhere herein, a form of refrigerant cycles through these components via refrigerant lines 28*b*, 28*c*, 28*d*. Ice produced by ice maker 110 is produced in ice formation device 120, the structure and operation of which is described more fully elsewhere herein.

A condenser fan 18 may be positioned to blow a gaseous cooling medium (e.g., air) across condenser 16 to provide cooling of condenser 16. Condenser fan 18 may include a fan motor 18*a* and fan blade(s) 18*b*, wherein the fan blades 18*b* are rotated by condenser fan motor 18*a*. As with ice maker 10, condenser fan motor 18*a* of ice maker 110 is adapted to operate in a forward direction to draw air through condenser 16 (see Arrows A in FIG. 1A) and is adapted to operate in a reverse direction to blow air through condenser 16 (see Arrows B in FIG. 1B). It will be understood that in other embodiments, that condenser fan motor 18*a* may be adapted to operate in a forward direction to blow air through condenser 16 and may be adapted to operate in a reverse direction to draw air through condenser 16, without departing from the scope of the invention. Preferably, fan motor 18*a* of condenser fan 18 is an electrically commutated motor (ECM) and the forward and reverse operation is controlled by controller 80 (see FIG. 2). The components of ice maker 110 are controlled by controller 80, as described more fully elsewhere herein. It will be understood that the operation of condenser fan motor 18*a* in ice maker 110 is substantially the same or the same as the operation of condenser fan motor 18*a* in ice maker 10.

The water system 114 of ice maker 110 includes water supply line for filling sump 170 with water from a water source (not shown). Some or all of the supplied water in sump 170 is supplied by water line 163 to ice formation device 120 where the water may be frozen into ice. Float valve 172 (see FIG. 5) in sump 170 may control the water level in ice making chamber 122.

Referring now to FIG. 5, ice formation device 120 includes a substantially cylindrical ice making chamber 122 surrounded by an evaporator (not shown) formed of a refrigerant line coiling around ice making chamber 122. The refrigerant line is in fluid communication with liquid line 28*c* and suction line 28*d*. The refrigerant line enters ice formation device 120 proximate a lower portion of ice making chamber 122, coils upward around ice making chamber 122, and exits ice formation device 120 proximate an upper portion of ice making chamber 122. The refrigerant in the refrigerant line warms as it rises in ice making chamber 122. Ice making chamber 122 and the refrigerant line is insulated by insulating foam or an insulated housing 120*a*. In certain embodiments, for example, ice making chamber 122 may be a brass or stainless steel tube.

Ice formation device 120 further includes an auger 121 coaxially located within substantially cylindrical ice making chamber 122. Auger 121 has a diameter slightly less than the diameter of ice making chamber 122. Auger 121 is rotated by auger motor 123, auger 121 removes the ice that forms on the inside of ice making chamber 122. The formed ice exits ice making chamber 120 out ice outlet 127. The direction of rotation of auger flight 121 causes ice that is formed on the inside of ice making chamber 122 to be lifted up toward the upper portion of ice making chamber 122. Water to be frozen into ice is supplied to ice making chamber by a water supply inlet 163*a* located proximate the lower end of ice formation device 120. Water supply inlet 163*a* and sump 170 are in fluid communication by water line 163.

At the start of the ice making cycle, water that is supplied to sump 170 flows through water line 163 and into ice making chamber 122 of ice formation device 120. The supplied water typically travels from sump 170 into ice making chamber 122 by gravity flow. The water level in ice making chamber 122 is typically equal to the height of the water in sump 170. Preferably, the water level in ice making chamber 122 is controlled by float valve 172 in sump 170. As cold refrigerant cycles through evaporator (not shown) of ice formation device 120 the water in ice making chamber 122 begins to freeze inside ice making chamber 122. Auger 121 continuously rotates to scrape the layer of ice formed on the inner wall of ice making chamber 122 and conveys the formed ice upward. The formed ice exits ice formation device 120 via ice outlet 127 where it may then be deposited into ice storage bin 31. It will be understood that ice maker 110 may include other elements known in the art for forming flake or nugget-type ice without departing from the scope of the invention. For example, embodiments of ice maker 110 may also include a nugget formation device (not shown) located proximate the top of auger flight 121 which extrudes the formed ice through small passageways thereby compacting and reducing the water content of the formed ice. As the compacted ice exits ice formation device 120 it is forced around a corner causing the ice to break into smaller pieces (nuggets) of ice.

Having described two types of ice makers, a grid-type ice maker 10 and a flake or nugget-type ice maker 110, the operation of condenser fan 18*a* to maintain a clean condenser 16 in ice makers 10, 110 is described in greater detail below. As described above, condenser fan 18 of grid-type ice maker 10 and/or flake or nugget-type ice maker 110 preferably operates continuously during the ice making cycle. After repeated ice making cycles, dirt, lint, grease, dust, and/or other contaminants collects on the front and/or rear faces of condenser 16 and/or in between the fins of condenser 16 by virtue of condenser fan 18 drawing air through condenser 16. The contaminants that collect on or in condenser 16 reduces the efficiency of condenser 16. This reduced efficiency can result in longer ice making times, reduced ice production, greater wear and tear on the components of ice maker 10, 110, and/or higher operating costs. In order to clean condenser 16 of the accumulated contaminants, condenser fan motor 18*a* may be operated by controller 80 in a reverse direction for a period of time. Operating condenser fan motor 18*a* in a reverse direction causes fan blades 18*b* to blow air through condenser 16. This air blown in the reverse direction causes at least a portion of, and preferably substantially all or all of, the contaminants to be blown out of and off condenser 16. Preferably, operation of condenser fan motor 18*a* in the reverse direction occurs when ice maker 10, 110 is not making ice. This is because operating condenser fan motor 18*a* in reverse during the ice making cycle may have a detrimental effect on the ice making performance of ice maker 10, 110. Thus, in certain embodiments, for example, condenser fan motor 18*a* may be operated in reverse when ice level sensor 74 senses an ice storage bin full condition. When ice storage bin 31 is full of ice, ice maker 10, 110 will stop making ice until the ice level drops below a certain level. That is, when ice storage bin 31 is full of ice refrigeration system 12, except for condenser fan motor 18*a*, will be off.

In various embodiments, the condenser fan motor 18*a* may be operated at a higher speed in the reverse direction than the speed that condenser fan 18*a* operates during a normal ice making cycle. That is, condenser fan 18*a* may operate at a first speed in the forward direction during an ice making cycle and condenser fan 18*a* may operate at a second speed in the reverse direction when the remaining components of refrigeration system 12 (e.g., compressor 15) are off.

Figure 6:
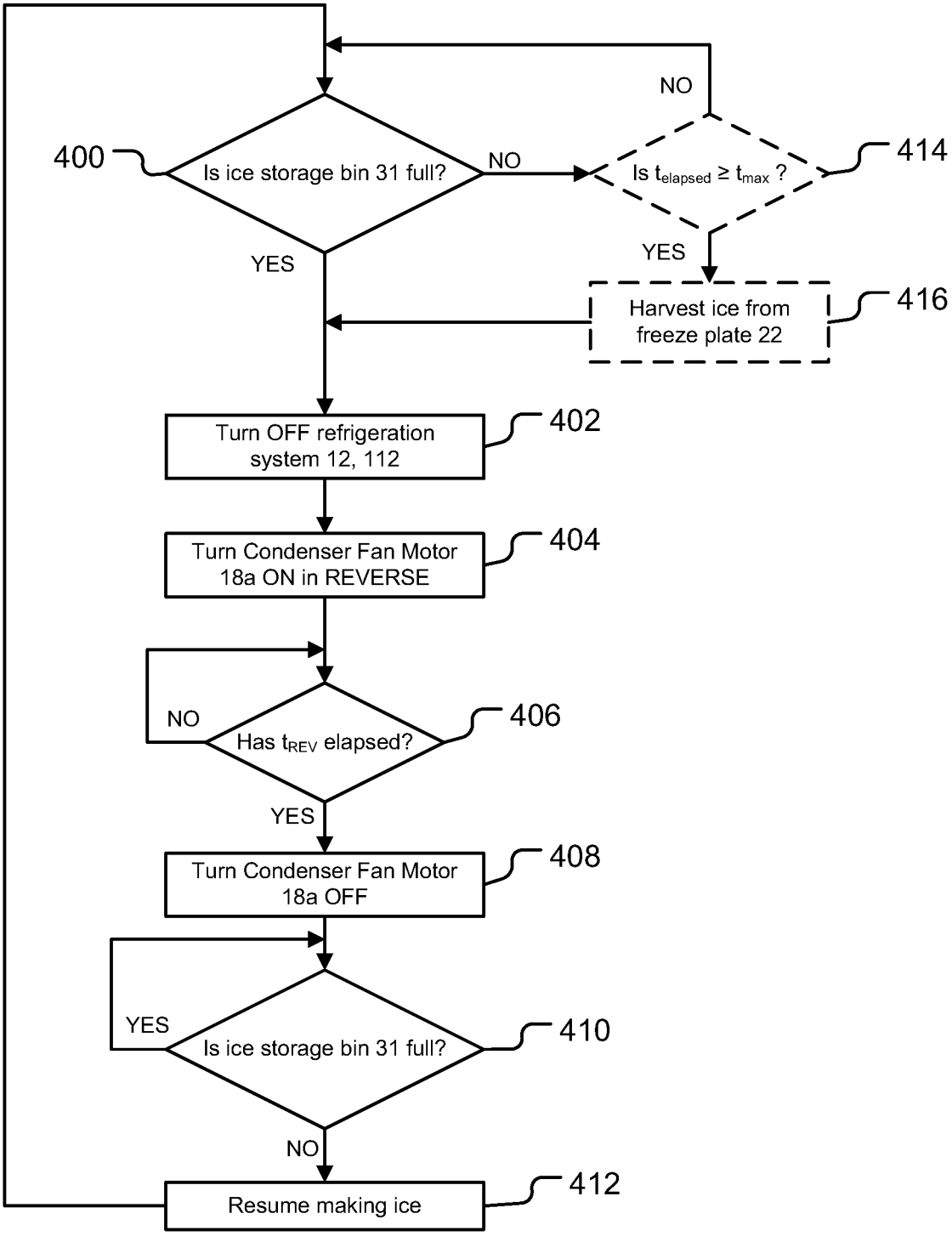
FIG. 6 is flow chart describing a method of operating a condenser fan motor of an ice maker in the reverse direction according to an embodiment of the invention.

Now with reference to FIG. 6, an embodiment of operating condenser fan 18*a* to clean condenser 16 of ice maker 10 and/or ice maker 110 is described. It will be understood that the described method of operating condenser fan motor 18*a* can apply equally to grid-type ice maker 10, flake or nugget-type ice maker 110, and/or any other type of ice maker known in the art that includes a condenser and condenser fan, without departing from the scope of the invention. That is, except where noted, the following references to components and modes of operations of various components should be understood to apply to both ice maker 10 and ice maker 110. If ice level sensor 74 senses that ice storage bin 31 is full at step 400, controller 80 turns off refrigeration system 12 at step 402. That is, controller 80 turns off compressor 15 and/or condenser fan motor 18*a* of refrigeration system 12, 112. With respect to ice maker 10, controller 80 also turns off water pump 62 of water system 14. Then at step 404, controller 80 turns on condenser fan motor 18*a* in the reverse direction to blow dirt, lint, dust, and/or other contaminants to be blown out of and off condenser 16. Preferably, the speed at which condenser fan 18*a* is operated in the reverse direction is faster than the speed at which condenser fan motor 18*a* is operated in the forward direction.

Controller 80 continues to operate condenser fan motor 18*a* in the reverse direction until a period of time ($t_{REV}$) elapses as shown in step 406. The period of time that condenser fan motor 18*a* is operated in reverse is a sufficient time to at least blow off a portion of, and preferably substantially all or all of, the contaminants from condenser 16. In various embodiments, the period of time ($t_{REV}$) that condenser fan motor 18*a* is operated in the reverse direction is from about 15 seconds to about 2 minutes (e.g., about 15 seconds, about 30 seconds, about 45 seconds, about 1 minute, about 1 minute and 15 seconds, about 1 minute and 30 seconds, about 1 minute and 45 seconds, about 2 minutes). Preferably, the period of time ($t_{REV}$) that condenser fan motor 18*a* is operated in the reverse direction is about 1 minute. In certain embodiments, for example, the period of time ($t_{REV}$) that condenser fan motor 18*a* is operated in the reverse direction is less than 15 seconds. In other embodiments, for example, the period of time ($t_{REV}$) that condenser fan motor 18*a* is operated in the reverse direction may be greater than 2 minutes. When the desired period of time ($t_{REV}$) has elapsed, controller 80 turns off condenser fan motor 18*a* at step 408.

After controller 80 turns off condenser fan motor 18*a*, the operation of ice maker 10, 110 pauses until ice level sensor 74 senses that ice storage bin 31 is no longer full at step 410. When ice storage bin 31 is no longer full of ice, controller 80 turns on refrigeration system 12, 112 (and water system 14 and/or water system 114, if previously turned off) to resume normal ice making at step 412.

Returning to step 400, if ice level sensor 74 senses that ice storage bin 31 is not full of ice, controller 80 may continue to operate ice maker 10, 110 normally to make ice. Optionally, controller 80 may monitor or determine the elapsed time from when condenser fan motor 18*a* last ran in the reverse direction. That is, controller 80 may be able to determine whether condenser fan motor 18*a* has been operated in the reverse direction at least once in a desired period of time. Controller 80 may include a timer which measures elapsed time. The elapsed time may be reset each time that condenser fan motor 18*a* is operated in the reverse direction. If the elapsed time ($t_{elapsed}$) that condenser fan motor 18*a* was last operated in the reverse direction is greater than or equal to the desired maximum time ($t_{max}$), controller 80 can proceed to operate condenser fan motor 18*a* in reverse. This may be done to ensure that, even if ice storage bin 31 is not full, condenser fan motor 18*a* operates in reverse on a periodic basis to keep condenser clean. In various embodiments, the maximum time between cycles of operating condenser fan motor 18*a* in the reverse direction ($t_{max}$) is from about 4 hours to about 48 hours (e.g., about 4 hours, about 6 hours, about 8 hours, about 10 hours, about 12 hours, about 16 hours, about 20 hours, about 24 hours, about 30 hours, about 36 hours, about 40 hours, about 48 hours). Preferably, the maximum time between cycles of operating condenser fan motor 18*a* in the reverse direction ($t_{max}$) is about 24 hours. That is, ice maker 10, 110 may be programmed to operate condenser fan motor 18*a* in the reverse direction once every day. In certain embodiments, for example, the maximum time between cycles of operating condenser fan motor 18*a* in the reverse direction ($t_{max}$) is less than 4 hours. In other embodiments, for example, the maximum time between cycles of operating condenser fan motor 18*a* in the reverse direction ($t_{max}$) may be greater than 48 hours.

Accordingly, at optional step 414, if the elapsed time ($t_{elapsed}$) is greater than or equal to the desired maximum time ($t_{max}$) that condenser fan motor 18*a* was last operated in the reverse direction, controller 80 may queue condenser fan motor 18*a* to operate in reverse. At optional step 416 specific to ice maker 10, controller 80 causes ice maker 10 to harvest ice from ice formation device 20. Preferably, when controller 80 determines that the elapsed time ($t_{elapsed}$) is greater than or equal to the desired maximum time ($t_{max}$), controller 80 will continue to operate ice maker 10, 110 normally. That is, controller 80 will not stop or interrupt an ice making cycle to operate condenser fan motor 18*a* in reverse. Thus, the harvesting of ice at step 416 may be the next harvest step that would occur at the end of a normal ice making cycle when the desired thickness of ice is reached in freeze plate 22. Once the harvesting step is complete, controller will proceed to operate condenser fan motor 18*a* in the reverse direction as outlined in steps 402-408 as described in greater detail above. In other embodiments, for example, when controller 80 determines that the elapsed time ($t_{elapsed}$) is greater than or equal to the desired maximum time ($t_{max}$), controller 80 may interrupt the normal ice making cycle. In such embodiments, the harvesting step at step 416 may be initiated by controller 80 even if the desired thickness of ice is not reached. Once the harvesting step is complete, controller will proceed to operate condenser fan motor 18*a* in the reverse direction as outlined in steps 402-408 as described in greater detail above.

Figure 7A:
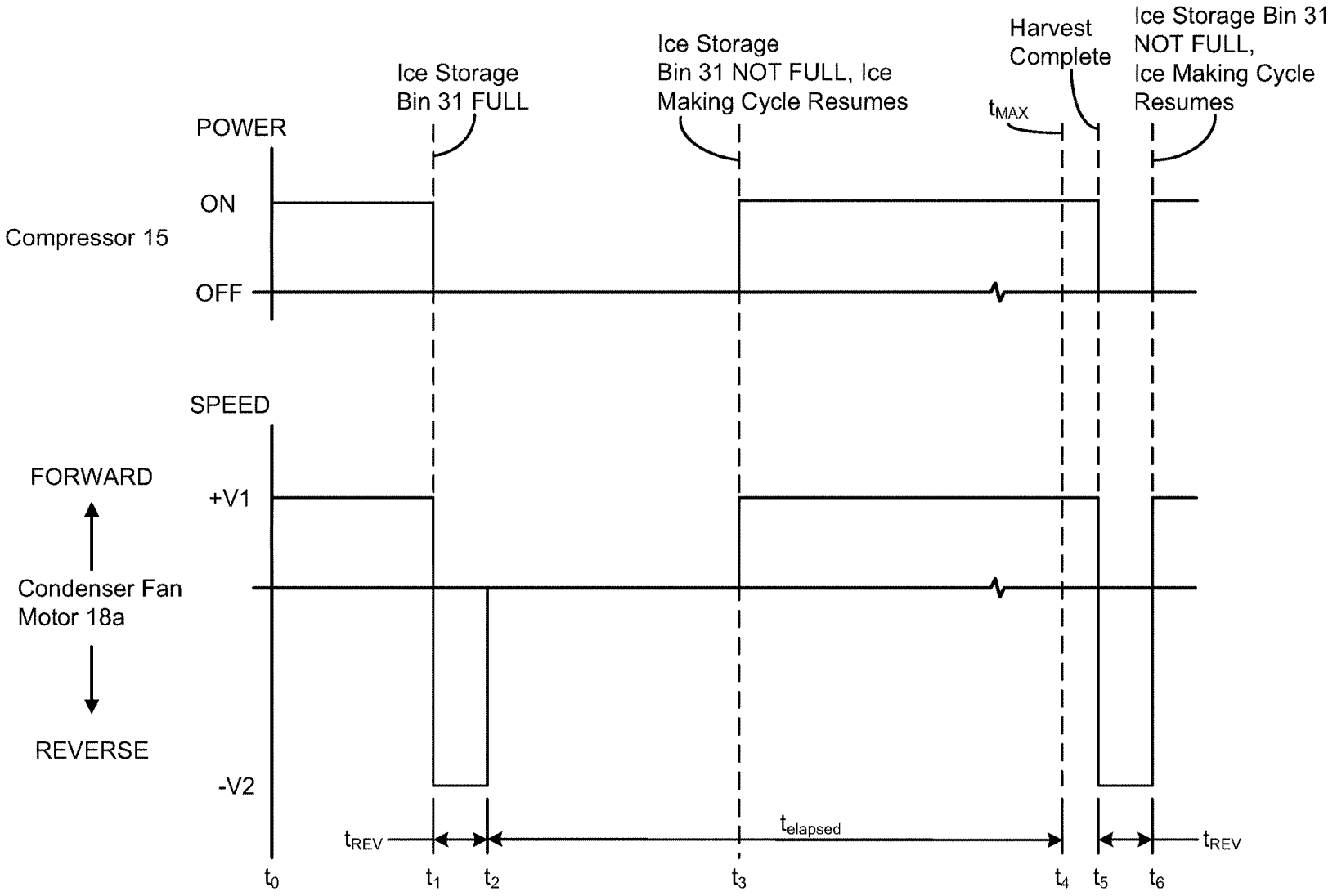
FIG. 7A is a time plot of a method of operating a condenser fan motor of an ice maker in the reverse direction according to an embodiment of the invention.
Figure 7B:
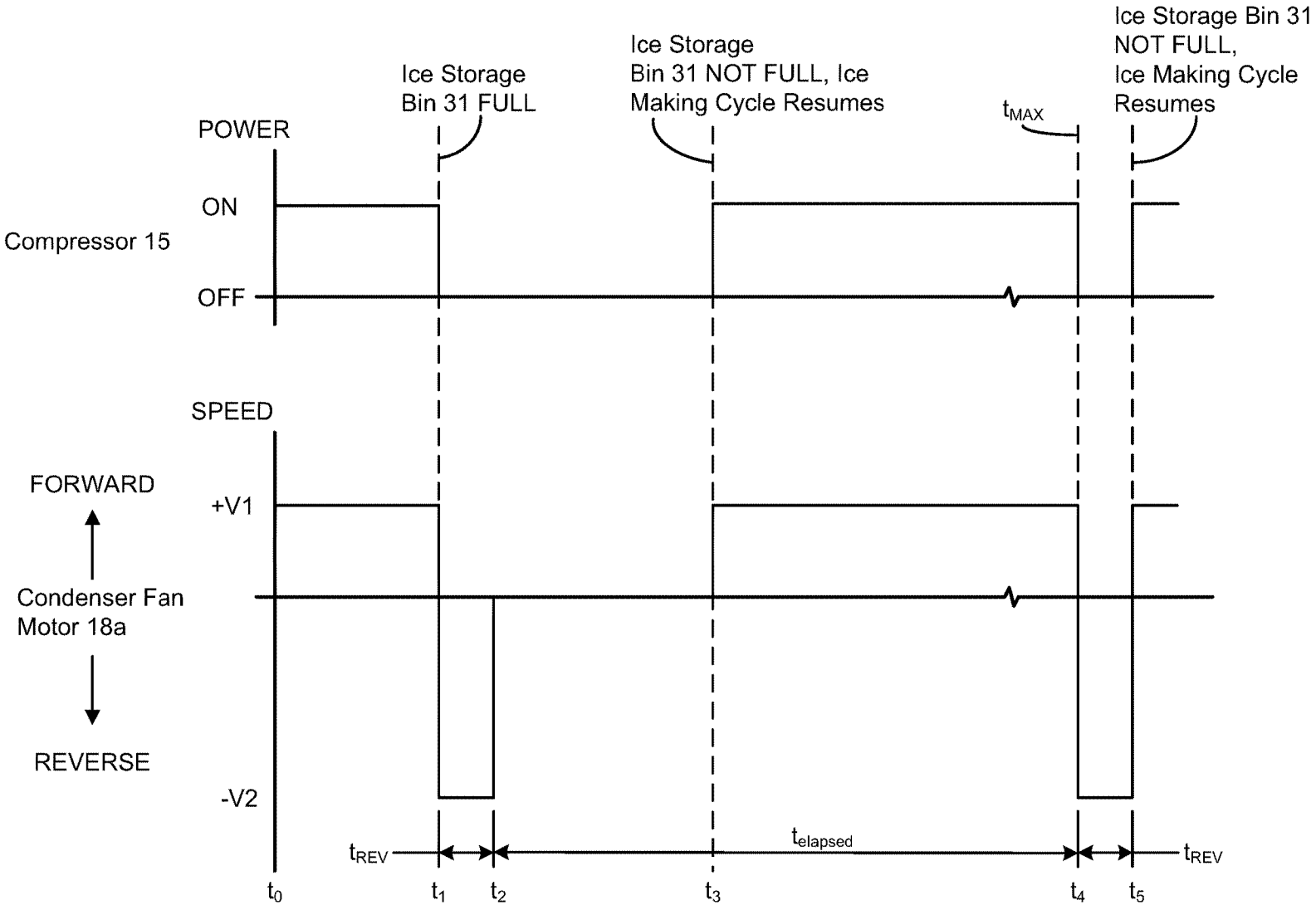
FIG. 7B is a time plot of a method of operating a condenser fan motor of an ice maker in the reverse direction according to an embodiment of the invention.

The method described above with respect to FIG. 6 is alternatively described in FIGS. 7A and 7B which illustrate time plots of the operating states of compressor 15 and condenser fan motor 18*a*. FIG. 7A illustrates the operation of ice maker 10 which includes optional harvest step at step 416 described above. As shown in FIG. 7A, between time $t_0$ and $t_1$, during an ice making cycle, compressor 15 is ON and condenser fan motor 18*a* is ON in the FORWARD direction at speed V1. At time $t_1$, ice level sensor 74 senses that ice storage bin 31 is full. Controller 80 thus turns compressor 15 OFF and turns condenser fan motor 18*a* ON in the REVERSE direction at speed V2. Operating condenser fan motor 18*a* in the REVERSE direction causes condenser fan 18 to blow dirt, lint, dust, and/or other contaminants from condenser 16. As described above, speed V2 is preferably higher than speed V1. In various embodiments, speed V2 may be substantially equal or equal to speed V1. Controller 80 continues to operate condenser fan motor 18*a* in the REVERSE direction to clean condenser 16 until a period of time ($t_{REV}$) has elapsed (shown from $t_1$ to $t_2$), at which point controller 80 turns condenser fan motor 18*a* OFF. The components of refrigeration system 12 (e.g., compressor 15) remain OFF from $t_2$ to $t_3$. Water pump 62 of water system 14 may also remain off from $t_2$ to $t_3$.

At $t_3$, ice level sensor 74 senses that ice storage bin 31 is no longer full and as a result the ice making cycle resumes with controller 80 turning compressor 15 ON and turning condenser fan motor 18*a* ON in the FORWARD direction at speed V1. Controller 80 continues to operate the components of ice maker 10 and therefore continues to make ice starting from $t_3$. However, unlike at $t_1$, ice storage bin 31 does not become full. This may occur as a result of continuous or near continuous demand for ice, for example, at a busy restaurant or bar where ice is regularly being removed from ice storage bin 31. Controller 80 monitors the elapsed time ($t_{elapsed}$) from the last time that condenser fan motor 18*a* was operated in the reverse direction. At $t_4$, the elapsed time ($t_{elapsed}$) is greater than or equal to the desired maximum time between reverse operations of condenser fan motor 18*a*. Thus, controller 80 either initiates a harvest cycle or waits until the next harvest cycle occurs. At $t_5$, the harvest cycle completes and controller 80 turns compressor 15 OFF and turns condenser fan motor 18*a* ON in the REVERSE direction at speed V2. Operating condenser fan motor 18*a* in the REVERSE direction causes condenser fan 18 to blow dirt, lint, dust, and/or other contaminants from condenser 16. Controller 80 continues to operate condenser fan motor 18*a* in the REVERSE direction to clean condenser 16 until a period of time ($t_{REV}$) has elapsed (shown from $t_5$ to $t_6$), at which point controller 80 turns condenser fan motor 18*a* OFF. At $t_6$, if ice storage bin 31 is still not full, controller 80 causes ice maker 10 to resume the ice making cycle by turning compressor 15 ON and turning condenser fan motor 18*a* ON in the FORWARD direction at speed V1.

FIG. 7B illustrates the operation of ice maker 10 which does not include optional harvest step at step 416 described above and also illustrates the operation of ice maker 110 which does not include a traditional harvest step. As shown in FIG. 7B, between time $t_0$ and $t_1$, during an ice making cycle, compressor 15 is ON and condenser fan motor 18*a* is ON in the FORWARD direction at speed V1. At time $t_1$, ice level sensor 74 senses that ice storage bin 31 is full. Controller 80 thus turns compressor 15 OFF and turns condenser fan motor 18*a* ON in the REVERSE direction at speed V2. Operating condenser fan motor 18*a* in the REVERSE direction causes condenser fan 18 to blow dirt, lint, dust, and/or other contaminants from condenser 16. As described above, speed V2 is preferably higher than speed V1. In various embodiments, speed V2 may be substantially equal or equal to speed V1. Controller 80 continues to operate condenser fan motor 18*a* in the REVERSE direction to clean condenser 16 until a period of time ($t_{REV}$) has elapsed (shown from $t_1$ to $t_2$), at which point controller 80 turns condenser fan motor 18*a* OFF. The components of refrigeration system 12, 112 (e.g., compressor 15) remain OFF from $t_2$ to $t_3$. Water pump 62 of water system 14 of ice maker 10 may also remain off from $t_2$ to $t_3$.

At $t_3$, ice level sensor 74 senses that ice storage bin 31 is no longer full and as a result the ice making cycle resumes with controller 80 turning compressor 15 ON and turning condenser fan motor 18*a* ON in the FORWARD direction at speed V1. Controller 80 continues to operate the components of ice maker 10, 110 and therefore continues to make ice starting from $t_3$. However, unlike at $t_1$, ice storage bin 31 does not become full. This may occur as a result of continuous or near continuous demand for ice, for example, at a busy restaurant or bar where ice is regularly being removed from ice storage bin 31. Controller 80 monitors the elapsed time ($t_{elapsed}$) from the last time that condenser fan motor 18*a* was operated in the reverse direction. At $t_4$, the elapsed time ($t_{elapsed}$) is greater than or equal to the desired maximum time between reverse operations of condenser fan motor 18*a* and controller 80 turns compressor 15 OFF and turns condenser fan motor 18*a* ON in the REVERSE direction at speed V2. Operating condenser fan motor 18*a* in the REVERSE direction causes condenser fan 18 to blow dirt, lint, dust, and/or other contaminants from condenser 16. Controller 80 continues to operate condenser fan motor 18*a* in the REVERSE direction to clean condenser 16 until a period of time ($t_{REV}$) has elapsed (shown from $t_4$ to $t_5$), at which point controller 80 turns condenser fan motor 18*a* OFF. At $t_5$, if ice storage bin 31 is still not full, controller 80 causes ice maker 10, 110 to resume the ice making cycle by turning compressor 15 ON and turning condenser fan motor 18*a* ON in the FORWARD direction at speed V1.

In certain installations of ice maker 10, 110, it may not be desired to have condenser fan motor 18*a* operate in the reverse direction every time that ice storage bin 31 is full. For example, ice maker 10, 110 may be installed in a kitchen of a restaurant or bar. Because condenser fan motor 18*a* preferably blows dirt, lint, dust, and/or other contaminants out the front of ice maker 10, 110 when operated in the reverse direction, it may be desirable to operate condenser fan motor 18*a* in the reverse direction when the kitchen is not in use. Doing so may reduce or prevent the dirt, lint, dust, and/or other contaminants blown from condenser 16 from landing on the kitchen staff and/or on or in the food products being prepared in the kitchen. Accordingly, controller 80 may be programmed to operate condenser fan motor 18*a* in the reverse direction only after the kitchen is closed, for example, at 3:00 or 4:00 am. It will be understood that controller 80 of ice maker 10, 110 may be programmed to operate condenser fan motor 18*a* in the reverse direction at any time of day. As described more fully elsewhere herein, controller 80 of ice maker 10, 110 may be programmed to operate condenser fan motor 18*a* in the reverse direction once a day, more than once a day, once every other day, etc. Preferably, controller 80 of ice maker 10, 110 is programmed to operate condenser fan motor 18*a* in the reverse direction once a day. Importantly, controller 80 will turn off the refrigeration system 12, 112 before operating condenser fan motor 18*a* in the reverse direction.

Figure 8A:
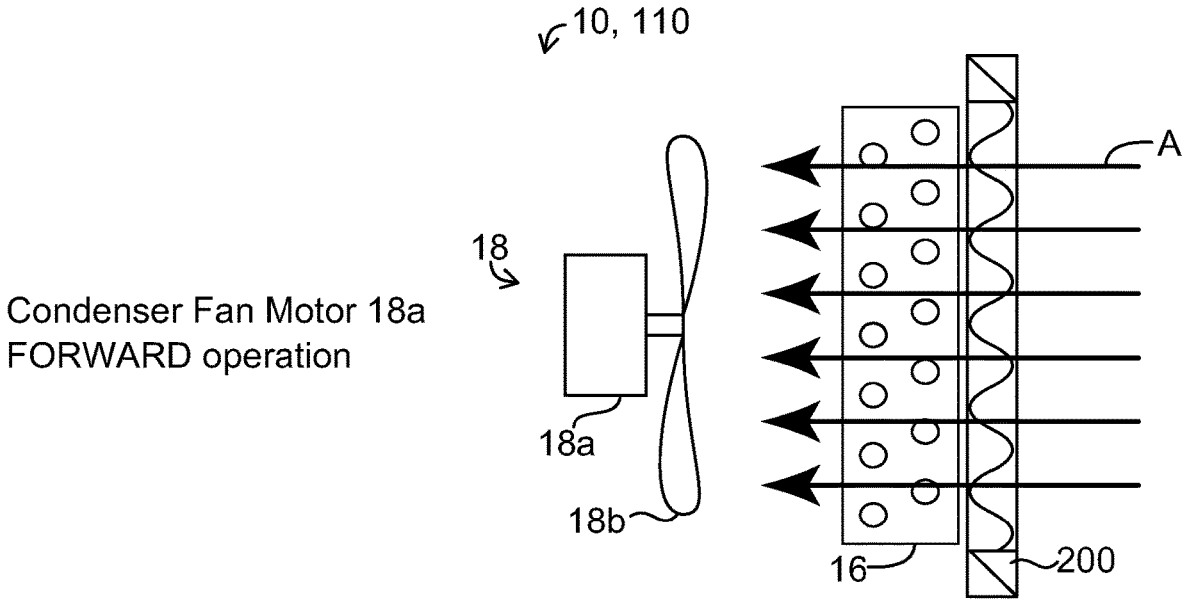
FIG. 8A is a schematic drawing of a condenser fan operating in a forward direction to draw air through a condenser and an air filter of an ice maker according to the first or second embodiments of the invention.
Figure 8B:
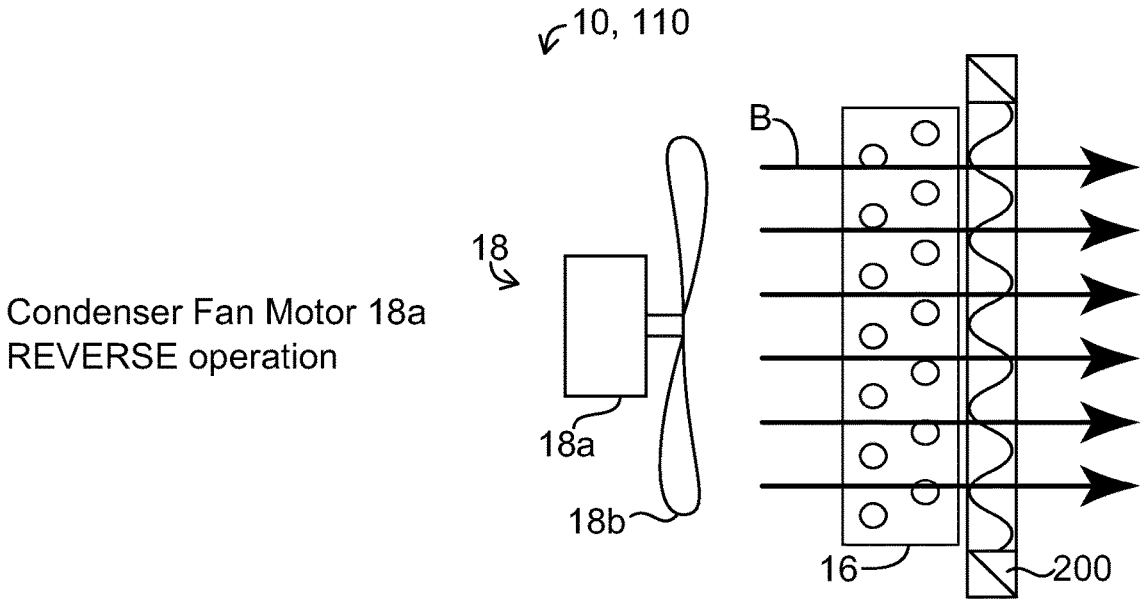
FIG. 8B is a schematic drawing of a condenser fan operating in a reverse direction to blow air through a condenser and an air filter of an ice maker according to the first or second embodiments of the invention.

Now with reference to FIGS. 8A and 8B, in alternative embodiments, for example, ice maker 10, 110 may also include an air filter 200 for filtering the air that is drawn into condenser 16 (see Arrows A in FIG. 8A). Including air filter 200 may reduce the amount of dirt, lint, grease, dust, and/or other contaminants entering condenser 16, which may assist in keeping condenser 16 clean and maintaining condenser 16 cooling capacity. In non-greasy environments, operating condenser fan motor 18*a* in the reverse direction as described herein may result in a self-cleaning system. That is, reversing the operation of condenser fan motor 18*a* will tend to clean air filter 200 by blowing dirt, lint, dust, and/or other contaminants trapped in air filter 200 out of air filter 200. Accordingly, air filter 200 may never need to be removed and cleaned. The use of an air filter 200 may be particularly desired, however, in greasy environments (e.g., kitchens) where grease can penetrate into condenser 16 and may cause dirt, lint, dust, and/or other contaminants to be trapped inside condenser 16. Air filter 200 may reduce the amount of or prevent grease from penetrating condenser 16 and operating condenser fan motor 18*a* in the reverse direction (see Arrows B in FIG. 8B) may blow a portion of the dirt, lint, dust, and/or other contaminants trapped by air filter 200 out of air filter 200. However, due to the grease, such contaminants may not be easily blown from air filter 200. Therefore, after air filter 200 becomes dirty from dirt, lint, grease, dust, and/or other contaminants, air filter 200 may be replaced, or if it is of the washable type, the air filter may be washed and replaced. Reversing the operation of condenser fan motor 18*a* may reduce the frequency with which air filter 200 will need to be cleaned. Therefore, operating condenser fan motor 18*a* in the reverse direction as described above may assist in keeping condenser 16 and air filter 200 clean and extend the time between air filter 200 replacement or cleaning.

While various steps of several methods are described herein in one order, it will be understood that other embodiments of the methods can be carried out in any order and/or without all of the described steps without departing from the scope of the invention.

Thus, there has been shown and described novel methods and apparatuses of an ice maker having reversing condenser fan motor for maintaining the condenser in a clean condition. It will be apparent, however, to those familiar in the art, that many changes, variations, modifications, and other uses and applications for the subject devices and methods are possible. All such changes, variations, modifications, and other uses and applications that do not depart from the spirit and scope of the invention are deemed to be covered by the invention which is limited only by the claims which follow.

What is claimed:

1. An ice maker for forming ice, the ice maker comprising:

(i) a refrigeration system comprising a compressor, a condenser, an ice formation device, and a condenser fan comprising a fan blade and a condenser fan motor for driving the fan blade, wherein the compressor, condenser and ice formation device are in fluid communication by one or more refrigerant lines;

(ii) a water system for supplying water to the ice formation device; and (iii) a control system comprising a controller adapted to operate the condenser fan motor at a first speed in a forward direction when the ice maker is making ice and adapted to operate the condenser fan motor at a second speed in a reverse direction when the ice maker is not making ice to reduce the amount of dirt, lint, dust, and/or other contaminants on or in the condenser;

wherein the controller is configured to:

turn the compressor on and begin operating the condenser fan motor at the first speed in the forward direction to cause the ice maker to make and harvest consecutive batches of ice, determine when the ice maker has been operating to continuously make and harvest consecutive batches of ice for a predefined interval of time;

in response to determining that the ice maker has been operating to continuously make and harvest consecutive batches of ice for the predefined interval of time, execute a condenser cleaning operation in which the controller:

harvests the ice from the ice maker by performing an ice harvesting operation consisting of one of:

initiating a harvest cycle; and waiting until the occurrence of a next harvest cycle;

after performing said ice harvesting operation:

turns off the compressor; and operates the condenser fan motor at the second speed in the reverse direction while the compressor is turned off.

2. The ice maker as in claim 1, wherein the ice maker is adapted to harvest ice into an ice storage bin and wherein the ice maker further comprises an ice level sensor, and wherein the controller is adapted to operate the condenser fan motor at the second speed in the reverse direction based upon an indication from the ice level sensor that the ice storage bin is full of ice.

3. The ice maker as in claim 1, wherein the second speed is greater than the first speed.

4. The ice maker as in claim 1, wherein the ice maker is adapted to operate the condenser fan motor in the reverse direction for 30 seconds to 2 minutes.

5. The ice maker as in claim 1, wherein the ice maker is adapted to operate the condenser fan motor in the reverse direction for 1 minute.

6. The ice maker as in claim 1, wherein the controller is programmed to operate the condenser fan motor in the reverse direction at least once per day.

7. The ice maker as in claim 1, wherein the controller is programmed to operate the condenser fan motor in the reverse direction at most once per day.

8. The ice maker as in claim 1, wherein the controller is programmed to operate the condenser fan motor in the reverse direction at specific time of day.

9. The ice maker as in claim 1, wherein the predefined interval of time is from 8 hours to 36 hours.

10. The ice maker as in claim 9, wherein the predefined interval of time is 24 hours.

11. The ice maker as in claim 1, wherein the ice maker further comprises an air filter to filter the air entering the condenser when the condenser fan motor is operating in the forward direction.

12. The ice maker as in claim 11, wherein the air filter is adapted to be cleaned by operating the condenser fan motor in the reverse direction.

* * * * *